United States Patent [19]

Faltin

[11] Patent Number: 4,565,363

[45] Date of Patent: Jan. 21, 1986

[54] APPARATUS FOR ACCURATELY SPACING A SEQUENCE OF SHINGLED PAPER SHEET PRODUCTS ON A CONVEYOR

[75] Inventor: Hans G. Faltin, York, Pa.

[73] Assignee: Custom-Bilt Machinery, Inc., York, Pa.

[21] Appl. No.: 608,518

[22] Filed: May 9, 1984

[51] Int. Cl.[4] ..... B65H 29/20

[52] U.S. Cl. ..... 271/315; 271/187; 271/243

[58] Field of Search ..... 271/314, 271, 216, 204, 271/315, 187, 243, 82

[56] References Cited

U.S. PATENT DOCUMENTS

| | | | |
|---|---|---|---|
| 1,949,152 | 2/1934 | Fankboner | 271/80 |
| 2,398,044 | 3/1946 | Rapley | 271/80 |
| 4,220,240 | 9/1980 | Norberg et al. | 271/204 |
| 4,434,979 | 3/1984 | Kobler et al. | 271/187 |

*Primary Examiner*—Bruce H. Stoner, Jr.
*Assistant Examiner*—John A. Carroll
*Attorney, Agent, or Firm*—Laurence R. Brown

[57] ABSTRACT

A rotary fan bucket type shingling system converts a high speed stream of paper products into a shingled array with the products moving at slower speeds, with the positions of the products defined more accurately than previously attainable with fixed stripping stops. This is achieved by means of movably positioning stripping stops to move into the path of the buckets and engage the paper products about a stripping arc defined by the bucket path with the stop moving at a speed less than that of the papers carried in the buckets. A mechanism is provided for holding the interceptor arm of the movable stripping stops substantially perpendicular to the paper product travel path over the stripping arc. The stripped products are shingled onto a conveyor belt tangentially disposed at the bottom of the bucket path moving at the same speed as that of the stripper stops. Accordingly, the spacing between the successive stripped shingled paper products may be very precisely defined at high speeds with products varying widely in weight and at various high speeds such as expected in newspaper operations.

8 Claims, 3 Drawing Figures

APPARATUS FOR ACCURATELY SPACING A SEQUENCE OF SHINGLED PAPER SHEET PRODUCTS ON A CONVEYOR

TECHNICAL FIELD

This invention relates to machinery for shingling sheet paper products, and more particularly it relates to systems for depositing folded paper products onto a conveyor belt at precisely spaced overlapping positions from rotary distribution "buckets" or "fans" fed from a high speed web press.

BACKGROUND ART

When handling sheet paper products travelling at high speed, such as newspapers from a printing press, they are conventionally slowed down in a shingling mechanism comprising a rotary fan distributor with a plurality of circumferentially located buckets for receiving the papers sequentially and dropping them in shingled array onto a conveyor belt. However, the conventional prior art is not satisfactory when accurate and precise spacing between the shingled papers at all speeds is necessary, as is the case if addressing equipment or the like is to receive the so shingled papers for further processing. One significant prior art problem arises from the fact that the paper products must come to a fixed stripper stop, letting the fingers of the "bucket" or "fan" move on while the papers drop onto the conveyor belt. Such can make the spacing very erratic when changes of press speed occur.

Another significant problem of the prior art is the displacement of the papers when they encounter a fixed position stripper stop for stripping the papers out of the buckets. At higher speeds the papers bounce off the stop into erratic positions.

The prior art providing a fixed position stripping member for displacing a paper product out of the bucket is typified by U.S. Pat. No. 1,949,152 issued to H. Fankboner on Feb. 27, 1934. This particular system has the further problem of limited speed because the papers are completely stopped and then reversed in conveyance direction. Higher speed is obtained in systems such as in U.S. Pat. No. 2,398,044 issued to H. H. Rapley on Mar. 19, 1946, wherein the papers are conveyed in the same direction as the travel of the bucket about the periphery of the rotary fan wheel. However, in this apparatus the spacing of the paper products is done by a toothed belt that intercepts the papers after being discharged from the bucket and while travelling along the conveyance belt. Thus, there must be frictional slip between the belt and the paper product which is almost impossible to control accurately in the presence of products that vary in speed, weight and flexibility.

Accordingly, it is an object of this invention to provide an improved system that overcomes the deficiencies of the prior art for accurately spacing a sequence of paper sheet products on a conveyor, particularly in shingled array, at varying speeds.

Other objects, features and advantages of the invention will be found throughout the following description, drawings and claims.

DISCLOSURE OF THE INVENTION

This invention provides apparatus for accurately spacing in shingled form onto a conveyor belt a sequence of folded paper sheet products being transported about the circumference of a rotary member, such as a fan distributor carrying successive paper products in peripheral buckets. Thus, cyclically movable means moves a set of interposer moving stops into position to intercept the paper products at a specified peripheral position while being carried in the bucket, thereby to strip the product from the bucket at a timing dependent upon the cyclic timing of the moving stops. This has one significant advantage of operability at high processing speeds because the moving stop may travel at a speed only slightly lower than that of the speed of the paper product carried in the bucket and thus does not either damage the product from impact or cause a variable placement on the conveyor from bouncing off a fixed stop.

A particular mechanism is afforded by this invention for positioning the moving stops of the movable stripper stop in a posture to engage the paper products while extending substantially perpendicular to the circumference of the rotary bucket carrying member and thus perpendicular to the path of the paper product over a specified arc distance of the bucket circumference over which the product is stripped from the bucket. Thus, the interceptor arms are moved over the arc at a speed less than at which the paper product is carried thereinto about the periphery of the bucket carrying member.

A specific mechanism embodiment of the invention provides a pivotable interceptor arm stripper element as one of a set of pivoted bars extending from spaced links on a chain link belt rotated about a sprocket wheel located adjacent said stripping arc position, which thereby maintains a substantially perpendicular posture to the travel path of the paper product carried in the bucket as it is being stripped.

THE PREFERRED EMBODIMENT

Figure 1:
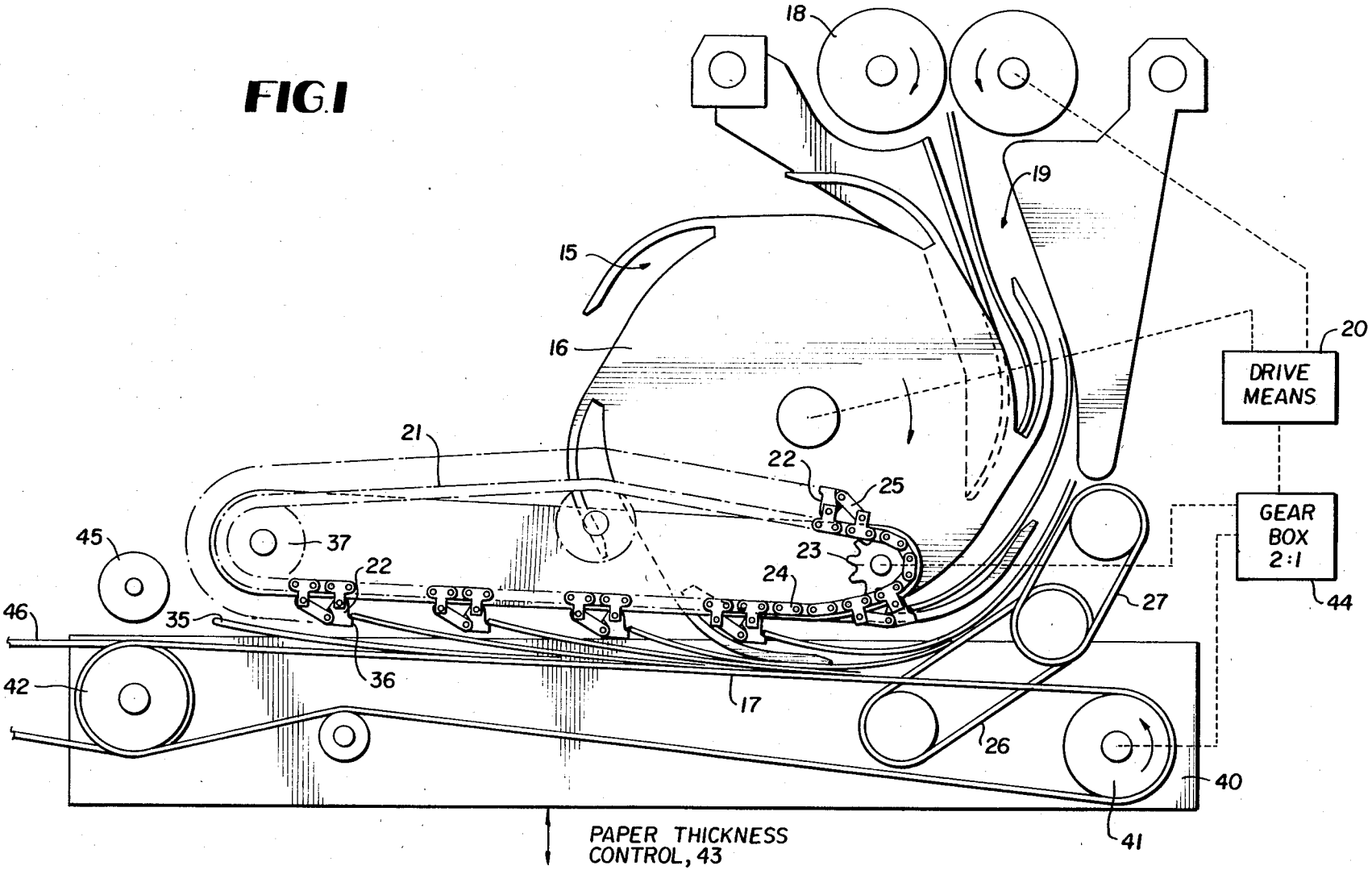
FIG. 1 is a diagrammatic side view sketch of a cross section through a portion of a paper product shingling system embodying the invention.

FIG. 1 illustrates the system afforded by this invention for transferring a sequence of shingled paper sheet products such as newspapers carried in the buckets 15 of the rotary fan distributor wheel 16 onto a conveyor belt 17 disposed substantially tangentially to the path of the buckets 15 at precisely spaced locations. The sheet products are fed into buckets 15 by nip rollers 18 by way of chute 19 in a conventional manner.

Synchronously timed with the presentation of buckets 15, by means of common drive means 20, the rotary cyclic stripper belt 21 presents the moving stripper interposer elements 22 to intercept the paper sheet products carried in the buckets 15 at a position where the buckets are tangentially approaching a parallel path alongside the conveyor belt 17. Thus, cog wheels 23 drive the link chain belt 24 in a circular path disposed adjacent the path of the buckets, thereby to insert synchronously stripper elements 22 into position for intercepting the paper sheet products carried in the successive buckets.

The stripper element interposer arms are pivoted on a carrying chain link so that they may be carried non-radially about the circular path defined by cog wheel 23 as they enter between successive paper positions. Therefore the stripper arms are disposed substantially perpendicular to the path of the paper sheet products carried in the buckets 15 when they intercept and follow the buckets to strip the products from the buckets, which would not occur without the linkage shown. This perpendicular posture of the intercepting arm bar 36 follows the circumference of the rotating fan distribution wheel 16 and thereby the path of the buckets 15 about a specified arc distance over which the paper product is stripped from the bucket and deposited on the conveyor belt 17.

To achieve this the stripping mechanism comprises a linkage having a pair of bars 36 and 25 pivoted respectively from different chain links so that the travel of the linkage about the circular path of cog wheel 23 will pivot interceptor arm stripper elements 22 non-radially over the described arc to follow the bucket 15 path with bar 36 substantially normally disposed to the paper and bucket travel path. This feature will later be discussed in more detail.

The speed of conveyor belt 17 in this embodiment is such that the conveyor belt 17 receiving the paper products 35 travels four inches (10 cm) for each paper product 35 released from the buckets 15. The spacing of interceptor bars 36 is similarly four inches (10 cm). Thus the papers 35 travel parallel to the conveyor belt 17 along the path of chain belt 21 in contact with interceptor stripper elements as held in place by the lip on bar 36 until released as the linkage starts its movement around sprocket 37 and drops the paper 35 in shingled position on the belt 17. Thus, the trailing edge of the papers 35 in contact with the moving stripper interposer elements 22 is pushed forward by the belt 17 to maintain the papers 35 in place and held by lips on bar 36 as shown. The speed of bucket distributor wheel 16 is greater than the four inches (10 cm) for each paper product, thus allowing each paper product 35 to overcome and engage a corresponding moving stop arm 22 for stripping of the paper product 35 out of its bucket 15. This avoids frictional drag on the conveyor belt system as the paper product is stripped.

The belts 26 and 27 are moved at a surface speed greater than that of belt 17, such as five to six inches (12.7 to 15.2 cm) per paper for receiving the trailing edge of a stripped product engaging the stripping elements 22 at the leading edge and pushing it positively against the stripping elements 22 during the stripping action in the vicinity of sprocket 23 and during transfer of the trailing edge onto belt 17.

All the drive speeds are synchronized as indicated by the dot-dash lines so that the stripper elements 22 are presented at the circumference of the fan distributor wheel 16 between two successive buckets while travelling at a speed less than the circumferential speed of the fan distributor wheel 16, thereby to permit the fan wheel buckets 16 to overtake the stripper elements 22 and thus achieve the stripping action. The paper product 35 is stripped from the bucket 15 as the bucket reaches its bottommost tangential position parallel to the conveyor belt 17.

It is clear therefore that because of the moving stripper stop member comprising stripper element 22 carried on chain belt 21, the paper products can be slowed down by the stop and stripped without the excessive impact of a fixed stop, which would tend to damage the paper products or to cause a bounce effect and misalignment on the receiving belts contrary to the purposes of this invention for precise spacing and alignment of the papers 35 on the conveyor belt 17.

Because of considerable change in thickness of newspaper products, for example, the movable framework 40 is able to variably position conveyor belt 17 extending between wheels 41 and 42 from the linkage elements 22, 25, by an appropriate mechanism as indicated by arrow 43.

Also as schematically shown, 2:1 gear box 44, is interposed between drive means 20 and both the chain belt 21, sprocket 23 drive and the belt 17 drive wheel 41. This permits the shingler to operate in the "collect run" mode when every other paper product would otherwise be missing.

Crush roller 45 may be provided to better erase the folds of the shingled products at the exit from belt 17 to succeeding conveyor belt 46 carrying the paper products 35 on to further processing stations.

Figure 2:
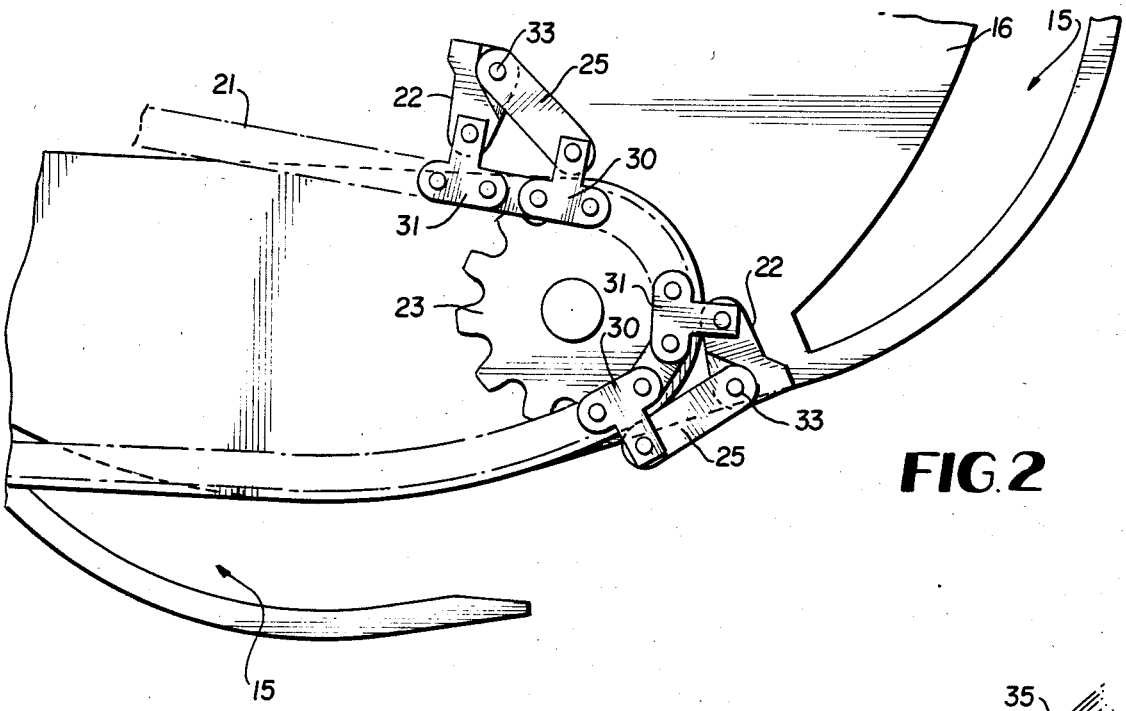
FIGS. 2 and 3 are side view sketches showing a sequence of movable interceptor arm positions moving about a circular path that maintains pivotable intercept arms substantially perpendicular to the path of the paper products while carried over a bucket stripping arc.
Figure 3:
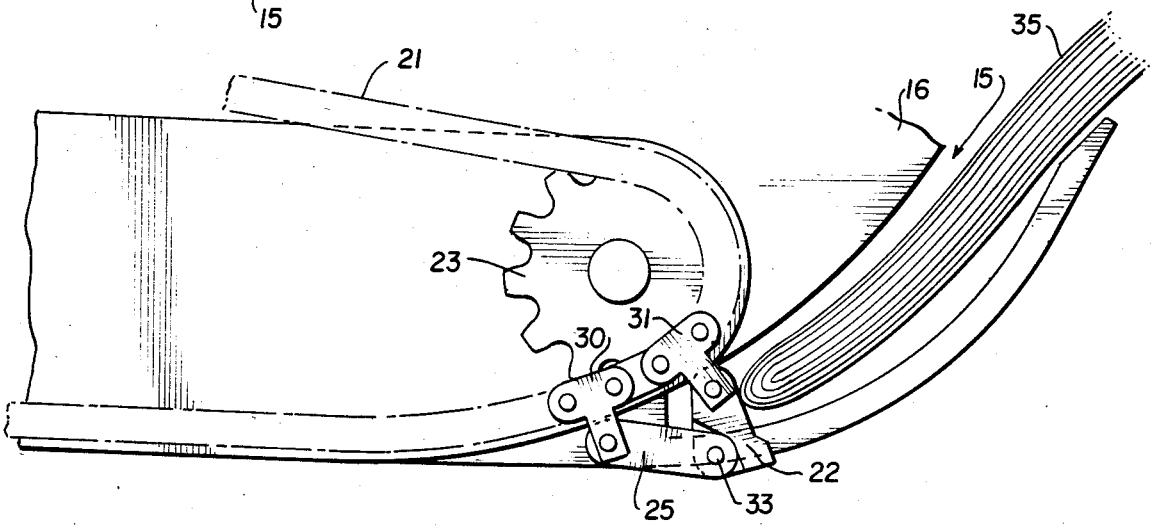

From FIGS. 2 and 3, it is seen that the stripper mechanism bars 22 and 25 are respectively pivoted to different links 30 and 31 of the chain belt drive 21, and are pivoted together at pin 33. This causes the stripper elements, as shown in FIGS. 2 and 3 when disposed at different positions about cog wheel 23 in the path of the papers 35 and buckets 15, to remain substantially perpendicular to the path of the buckets 15 over the stripping arc extending from entry of the stripper element 22 into the path until the paper product is removed from the bucket 15.

By means of this invention therefore, the paper product 35, typically a newspaper, can be stripped from the buckets 15 and deposited upon the conveyor belt 17 in shingled array precisely spaced and timed over very large differences in weight and speed, etc. In particular this system is operable at very high speeds compatible with modern printing press operations. Such precise spacing, required for presentation to further processing equipment such as clamp gripper conveyor systems, addressing equipment, etc. could not have been reliably obtained with prior art equipment having fixed stop stripping interposers, or those which introduce a significant friction component because of dragging the paper products over a belt or other surface.

Accordingly, this invention has improved the state of the art by providing a precision shingler with a moving stripper stop, and those features of novelty believed descriptive of the nature and spirit of the invention are defined with particularity in the following claims.

I claim:

1. A system for locating a plurality of sheet paper products transferred successively from locations in peripherally located buckets of a rotary fan distributor onto a conveyor belt disposed substantially tangentially to the path of the buckets with the paper products located at precisely spaced locations on the belt in a shingled array, comprising in combination, a set of spaced stripper mechanisms carried by a rotary cyclic stripper belt array synchronously timed to place stripper elements in the path of said buckets to intercept each of the paper products carried in the buckets with the stripper elements travelling at a lower speed than that of the buckets thereby to strip the paper products out of the buckets for deposit on the conveyor belt for transport, stripper belt drive means for rotating the stripper belt about a circular path of predetermined radius disposed adjacent the path of the buckets at a position for intercepting the paper products with the stripper element by the passage of the stripper elements circumferentially about part of said circular path into the path of the buckets carrying the paper products, and stripper element structure comprising an interceptor arm disposed substantially perpendicular from the stripper belt before it enters the circular path supported by a linkage carried by the stripper belt connected to the interceptor arm that maintains the interceptor arm disposed in a posture when it travels about said circular path to insert the interceptor arm substantially perpendicular to the path of paper products carried by the buckets thereby to engage the leading edge of the paper products carried about the bucket path as each successive paper product is presented to strip it from the bucket for deposit on said conveyor belt.

2. The system defined in claim 1 wherein the stripper belt comprises a link chain assembly and the stripper element interceptor arm is pivotally extended from one chain link and the linkage comprises a pivoted link arm connected from a further chain link to the interceptor arm wherein the two chain links are so spaced compared with said circular path to effect said posture of the interceptor arm.

3. The system defined in claim 1 wherein the conveyor belt is disposed parallel to a stripper belt path tangentially disposed at the bottom of the rotary fan, the interceptor arm being disposed into the bucket path at a position before each bucket reaches a bottommost tangential position parallel to the conveyor belt.

4. The system defined in claim 3 including a further cyclically movable belt assembly disposed about the periphery of the fan wheel at an angle to said conveyor belt and travelling at a higher belt speed disposed to receive and push the trailing edge of the paper products against the interceptor arms as the paper products are transferred onto the conveyor belt.

5. A system as defined in claim 1 wherein the stripper belt drive means comprises a chain link belt and the stripper mechanism comprises a pair of bars pivoted on separate links in said chain link belt and pivoted together thereby to provide said posture about said circular path.

6. Apparatus as defined in claim 5 wherein a plurality of stripper elements are positioned on a cyclically movable belt to move the stripper elements in the direction of travel toward the conveyor at a speed less than that of the speed of the product carried in the bucket while being stripped therefrom.

7. Apparatus for accurately spacing a sequence of paper sheet products on a conveyor, comprising in combination, a rotary fan distributor for receiving said products sequentially in a set of circumferentially spaced buckets rotatably positioned to travel tangentially to said conveyor for depositing the products thereupon, at least one cyclically movable stripper element moved at a lower speed than said buckets by accompanying synchronous means to move into and intercept the path of the products and strip the paper products from the buckets as they travel alongside the conveyor thereby to accurately position the leading edge of each successive product on the conveyor a fixed distance from the leading edge of the preceding stripped product and means for presenting the stripper element in a posture to extend substantially perpendicular to the path of the paper product carried in the buckets during the stripping operation, thereby to intercept and strip the products wherein the synchronous means comprises a link chain belt and the stripper elements comprise a set of pivoted bars connected to different links in the chain belt.

8. Apparatus as claimed in claim 7 wherein the stripper elements comprise two bars pivoted together and pivoted respectively to different links on the chain link belt.

* * * * *